US008427262B2

(12) United States Patent
Choi

(10) Patent No.: US 8,427,262 B2
(45) Date of Patent: Apr. 23, 2013

(54) ELECTROMAGNETIC CONTACTOR WITH ABRASION PREVENTING MEANS

(75) Inventor: Gwan Ho Choi, Chungcheongbuk-Do (KR)

(73) Assignee: LS Industrial Systems Co., Ltd., Gyeonggi-Do (KR)

( * ) Notice: Subject to any disclaimer, the term of this patent is extended or adjusted under 35 U.S.C. 154(b) by 287 days.

(21) Appl. No.: 12/624,770

(22) Filed: Nov. 24, 2009

(65) Prior Publication Data

US 2010/0134224 A1 Jun. 3, 2010

(30) Foreign Application Priority Data

Dec. 3, 2008 (KR) ..... 10-2008-0122118

(51) Int. Cl.
*H01H 67/02* (2006.01)

(52) U.S. Cl.
USPC ..... 335/132

(58) Field of Classification Search ..... 335/132, 335/202
See application file for complete search history.

(56) References Cited

U.S. PATENT DOCUMENTS 3,194,920 A 7/1965 Scheib, Jr.
3,870,980 A * 3/1975 Pollmann ..... 335/202
4,281,305 A * 7/1981 Weeks ..... 335/132
6,823,757 B2 * 11/2004 Kobayashi ..... 74/473.12
2006/0119455 A1 6/2006 Park

FOREIGN PATENT DOCUMENTS

| | | |
|---|---|---|
| DE | 29823818 | 12/1999 |
| EP | 0948016 | 10/1999 |
| GB | 759406 | 10/1956 |

OTHER PUBLICATIONS

China Office action, dated Feb. 29, 2012 along with an english translation thereof.
Search report from E.P.O., mail date is Jul. 5, 2012.

* cited by examiner

*Primary Examiner* — Elvin G Enad
*Assistant Examiner* — Lisa Homza
(74) *Attorney, Agent, or Firm* — Greenblum & Bernstein P.L.C.

(57) ABSTRACT

An electromagnetic contactor is provided an electromagnetic contactor including an upper frame having a fixed contact point and a guide rail; a cross bar comprising a sliding portion engaged with the guide rail, a movable contact point contacting and separating with respect to the fixed contact point while sliding along the guide rail, and a movable core; and a lower frame comprising a fixed core disposed adjacent to the movable core, an excitation coil magnetizing the fixed core by an electromotive force, and a return spring exerting an elastic force to the cross bar, wherein the sliding portion is configured separately from the cross bar, and a material forming the sliding portion has a friction coefficient against the guide rail less than that of the cross bar.

7 Claims, 4 Drawing Sheets

ELECTROMAGNETIC CONTACTOR WITH ABRASION PREVENTING MEANS

CROSS-REFERENCE TO RELATED APPLICATIONS

Pursuant to 35 U.S.C. §119(a), this application claims the benefit of earlier filing date and right of priority to Korean Application No. 10-2008-0122118 filed on Dec. 3, 2008, the contents of which are incorporated by reference herein in its entirety.

BACKGROUND OF THE INVENTION

1. Field of the Invention

The present invention relates to an electromagnetic contactor having an abrasion preventing means, and more particularly, to an electromagnetic contactor having a means for preventing an sliding portion of a cross bar within the electromagnetic contactor, which is mainly used for opening or closing a motor circuit, from being abraded.

2. Description of the Related Art

In general, an electromagnetic contactor or electromagnetic switch is most generally used when electrically connecting or disconnecting between a power source and a load. The contactor connects or disconnects between two fixed electrodes spatially separated from each other through a moving electrode, in which the force of an electromagnet is used when connecting to each other and the elastic force of a spring or the like is used when disconnecting from each other.

For such a conventional electromagnetic contactor, a cross bar is slidably provided within an upper frame and a lower frame thereof, and an electromotive force is applied to an excitation coil adjacent to a fixed core to magnetize the fixed core, and then a magnetic force generated by the magnetization is applied to pull a movable core mounted on the cross bar to a side of the fixed core, thereby sliding the cross bar. Due to that, it is configured in such a manner that a fixed contact point being fixed and provided at the upper frame is contacted or separated with respect to a movable contact point provided at the cross bar based on a sliding movement of the cross bar, thereby opening or closing a circuit connected to the fixed contact point.

On the other hand, the electromagnetic contactor should have a predetermined insulation as well as should withstand high-temperature heat generated therewithin during the operation. Accordingly, the cross bar and upper/lower frames are formed by using a thermosetting resin.

However, such a thermosetting resin has a relatively high rigidity, thereby easily causing an abrasion when continuously rubbing against each other as described above. In other words, in the electromagnetic contactor, the cross bar continuously repeats to make a sliding movement during the operation and thus a sliding portion of the cross bar may be gradually worn out due to friction during the process. If the abrasion is accumulated, then the sliding movement of the cross bar may be deteriorated, and therefore a contact between the fixed contact point and the movable contact point may be deteriorated, thereby decreasing the reliability of the equipment. Moreover, due to abrasion, dust is generated within the upper and lower frames and it may be a cause of the contact failure and burning damage, thereby reducing the life of the equipment.

SUMMARY OF THE INVENTION

The present invention is contrived to overcome the foregoing disadvantage in the related art, and it is a technical subject of the present invention to provide an electromagnetic contactor having a means for preventing a sliding portion from being abraded by minimizing the friction of a sliding portion of a cross bar even when used for a long period of time.

In order to accomplish the foregoing technical subject, the present invention may provide an electromagnetic contactor including an upper frame having a fixed contact point and a guide rail; a cross bar including a sliding portion sliding on the guide rail, a movable contact point contacting and separating with respect to the fixed contact point while sliding along the guide rail, and a movable core; and a lower frame including a fixed core disposed adjacent to the movable core, an excitation coil magnetizing the fixed core by an electromotive force, and a return spring exerting an elastic force to the cross bar, wherein the sliding portion is configured separately from the cross bar, and a material forming the sliding portion has a friction coefficient against the guide rail less than that of the cross bar. In other words, according to the present invention, a slide portion corresponding to a portion contacting the cross bar and guide rail is configured with a material having a lower friction coefficient than that of the cross bar body to reduce friction therebetween, thereby preventing abrasion thereof. Through this, the cross bar is configured with a material most suitable for operating the electromagnetic contactor, and the sliding portion is configured with a material suitable for preventing abrasion, thereby maintaining the performance of an electromagnetic contactor as well as minimizing abrasion due to the sliding movement.

Preferably, the sliding portion may have a block form extending from a side of the cross bar in a sliding direction. At this time, both ends of the contact surface of the sliding portion adjoining the guide rail may be rounded in order to prevent a front end of the contact surface from being stuck on a surface of the guide rail. In addition, the sliding portion may be formed in an oval or round shape, or the like. Furthermore, the sliding portion may be formed of a plate, which surrounds part of the cross bar. In this case, the sliding portion may be positioned between the cross bar and the guide rail.

Here, the sliding portion may be formed of any material having a lower friction coefficient than that of the cross bar, for example, a stainless material.

On the other hand, the sliding portion may include a body portion and a contact portion protruded to a side of the guide rail from the body portion. In other words, the body portion has a width smaller than that of the guide rail, and the contact portion is only brought into contact with the guide rail, thereby reducing an amount of material consumed in producing the sliding portion and facilitating dimensional control thereof during the production.

Here, the body portion may include two or more contact portions with respect to a side of the guide rail.

Furthermore, the present invention may provide an electromagnetic contactor including a frame having a guide rail thereinside; a cross bar having a movable contact point, which slides along the guide rail; a fixed contact point contacting or separating with respect to the movable contact point; and an actuator moving the cross bar to a side of the fixed contact point, wherein the cross bar additionally comprises a sliding portion adjoining the guide rail, and a friction coefficient between the sliding portion and the guide rail is less than a friction coefficient between the cross bar and the guide rail.

Here, the actuator may include a movable core mounted at the cross bar; a fixed core mounted at the frame; and an excitation coil magnetizing the fixed core by an electromotive force.

Furthermore, the present invention may provide an electromagnetic contactor including an upper frame having a fixed contact point and a holder; a cross bar comprising a guide portion slidably fixed at an inner side of the holder, a movable contact point contacting and separating with respect to the fixed contact point while sliding, and a movable core; and a lower frame comprising a fixed core disposed adjacent to the movable core, an excitation coil magnetizing the fixed core by an electromotive force, and a return spring exerting an elastic force to the cross bar, wherein a friction coefficient between the guide portion and the holder is less than a friction coefficient between the cross bar and the upper frame.

Here, the holder may be provided to replace a conventional guide rail, and it may be configured with a material having a low friction coefficient, thereby preventing abrasion thereof.

Preferably, a through hole may be formed at an inner side of the holder, and the guide portion may be inserted and fixed within the through hole.

Here, the holder may be made of a stainless material.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereinafter, an embodiment of an electromagnetic contactor having an abrasion preventing means according to the present invention will be described in detail with reference to the accompanying drawings.

Figure 1:
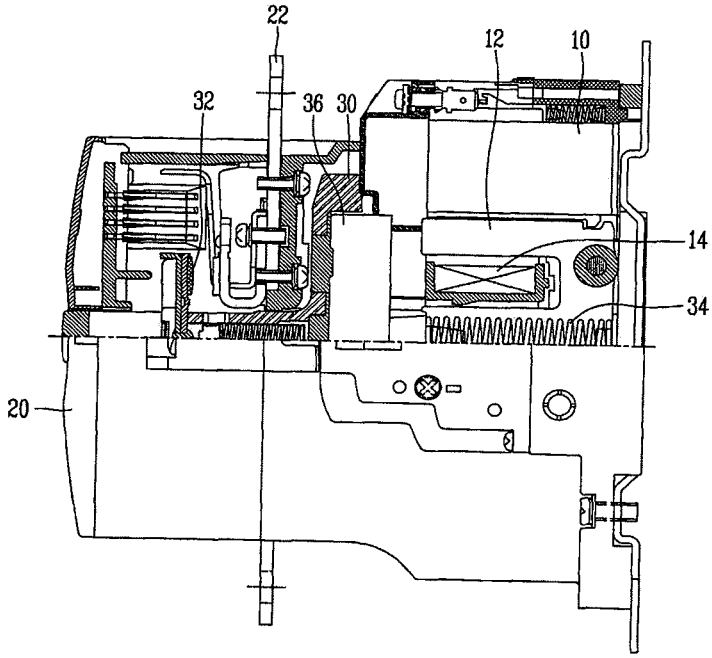
FIG. 1 is a cross-sectional view illustrating a first embodiment of an electromagnetic contactor having an abrasion preventing means according to the present invention.

Referring to FIG. 1, an embodiment of an electromagnetic contactor according to the present invention is illustrated. The electromagnetic contactor include a lower frame 10, an upper frame 20 covering an upper portion of the lower frame 10, and a cross bar 30 slidably provided in a vertical direction of the upper frame within a predetermined range inside the upper frame.

Furthermore, a fixed contact point 22 for opening or closing the circuit is provided inside the upper frame 20, and a movable contact point 32 is disposed in a state of being fixed to the cross bar 30 at a position facing the fixed contact point 22. A return spring 34 is provided at a rear surface of the cross bar 30, thereby exerting an elastic force for returning the cross bar 30 to an original position when the cross bar 30 is retreated out of a predetermined range.

On the other hand, a fixed core 12 and an excitation core 14 for magnetizing the fixed core 12 are provided within the lower frame 10. Furthermore, a movable core 36 is disposed in a state of being fixed to the cross bar 30 at a position facing the fixed core 12. For the electromagnetic contactor, an external electromotive force is applied to the excitation core 14, and it magnetizes the fixed core 12. The magnetic force of the magnetized fixed core 12 pulls the movable core 36 to a side of the fixed core 12, and due to this the cross bar 30 is slidably moved to the right side of FIG. 1 while contracting the return spring 34, thereby the movable contact point 32 adjoining the fixed contact point 22 to connect the circuit.

Then, if the electromotive force is removed, then the cross bar 30 that has been moved to a side of the fixed core 12 by the magnetic force returns to an initial position by an elastic force of the return spring 34 and the movable contact point 32 is separated from the fixed contact point 22 to block the circuit.

Figure 2:
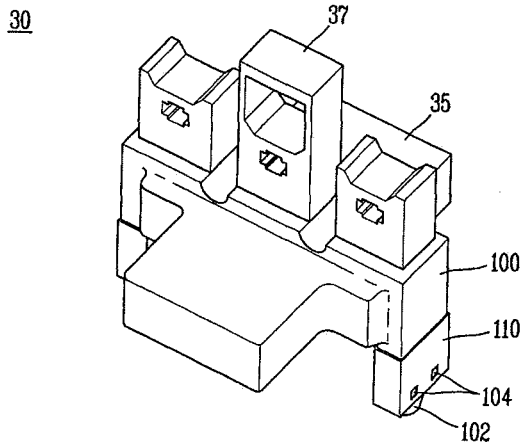
FIG. 2 is a perspective view illustrating an enlarged cross bar in an embodiment as illustrated in FIG. 1.

FIG. 2 is an enlarged view illustrating the cross bar 30.

The cross bar 30 is formed to be protruded to both sides of the central portion thereof, and it may include a movable core fixed portion 35 to which the movable core 36 is fixed on the rear surface thereof. Furthermore, it may include a movable contact point fixed portion 37 protruded from the movable core fixed portion 35 to the front surface thereof, and further include a pair of guide portions 100 formed to be extended to a rear side of the movable core fixed portion 35.

The guide portion 100 is positioned within guide rails 25, which will be described later to play a role of guiding a sliding movement of the cross bar 30. A cylindrically-shaped end portion 102 is formed at an end of the guide portion 100, and a pair of fixed protrusions 104 are protruded at the lateral surface thereof adjacent to the end portion 102. Furthermore, a slide portion 110 is inserted and fixed in the vicinity of the end portion 102 of the guide portion 100. The coupling relation of the guide portion 100 and the slide portion 110 will be described later.

Figure 3:
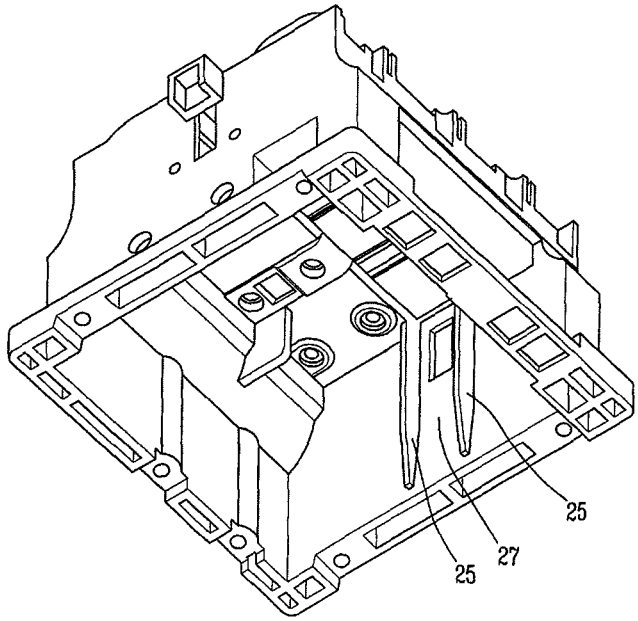
FIG. 3 is a perspective view illustrating an enlarged upper housing in an embodiment as illustrated in FIG. 1.

FIG. 3 is a view illustrating an inside of the upper frame 20 provided with the cross bar 30. The upper frame 20 has a substantially rectangular box-shaped form as a whole, and the bottom surface thereof is open to accommodate the lower frame 10. On the other hand, guide rails 25 extended in parallel to each other are formed at a pair of inner surfaces 27 facing each other on an inner surface of the upper frame 20. The guide rails 25 are extended in a sliding direction of the cross bar 30 as described above to guide a movement of the cross bar 30 in a state of the guide portion 100 being inserted thereinside.

Figure 4:
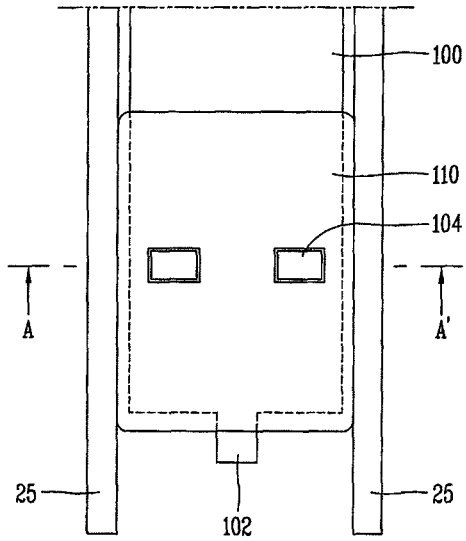
FIG. 4 is a plan view schematically illustrating a coupling state of the cross bar and the guide rail in an embodiment as illustrated in FIG. 1.

Referring to FIG. 4, the operation of the foregoing embodiment will be described.

FIG. 4 is a plan view schematically illustrating a state in which the guide portion 100 is coupled to the guide rails 25. Here, a width between the guide rails 25 is set to slightly larger than that of the guide portion 100, thereby minimizing a contact with the guide rails 25 of the guide portion 100 during the operation. The slide portion 110 has a cap shape covering an end of the guide portion 100, and the end portion 102 penetrates an end thereof to be protruded outward.

Figure 5:
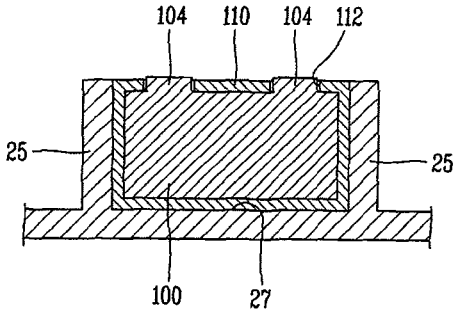
FIG. 5 is a cross-sectional view taken along the line A-A' of FIG. 4.

Furthermore, as illustrated in FIG. 5, two fixed holes 112 are formed on a surface of the slide portion 110 to prevent the slide portion 110 from being leaving out of the guide portion 100 during the sliding process, and fixed protrusions 104 are inserted through the fixed holes 112.

Here, the fixed protrusions 104 are not necessarily two, and also the shape thereof should not be limited to a rectangular shape, and therefore, it will be apparent to those skilled in the art that the fixed protrusions 104 can be modified in various suitable forms. For example, the fixed protrusions 104 may be in a round shape.

The slide portion 110 moves, namely, slides while adjoining an inner surface of the guide rails 25 in a state of being fixed to an end of the guide portion 100. Here, the slide portion 110 is made of a material different from the guide portion 100 made of a heat-curing resin, specifically, a material having a lower friction coefficient against the guide rails 25 than that of the guide portion 100. In the illustrated embodiment, the slide portion 110 is formed of a stainless material.

The slide portion 110 formed of the stainless material has a lower friction coefficient than that of the guide portion 100 made of a heat-curing resin, and frictional resistance is drastically reduced, thereby reducing abrasion thereof. Furthermore, stainless material is advantageous over heat-curing resin from the standpoint of rigidity, and thus has a high abrasion resistance, thereby minimizing abrasion thereof. Moreover, the slide portion 110 is rounded in the vicinity of each vertex thereof, thereby preventing the vertex from being stuck to the guide rails 25 to obstruct the movement thereof during the sliding process.

Here, the slide portion 110 is not required to be configured in a box form in which it is vacant, and may be also configured in a block form that is fixed to the guide portion 100. In this case, the slide portion 110 may be insert-molded together with the guide portion 100.

Figure 6:
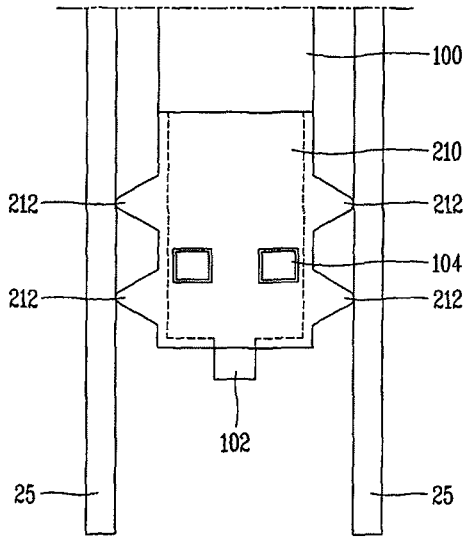
FIG. 6 is a view equivalent to FIG. 4 schematically illustrating a second embodiment of an electromagnetic contactor having an abrasion preventing means according to the present invention.

A second embodiment of the sliding portion is illustrated in FIG. 6. The remaining configuration excluding the guide portion and sliding portion in the second embodiment is similar to the first embodiment that has been described with reference to FIGS. 1 through 3, and the redundant description thereof will be omitted.

In a second embodiment as illustrated in FIG. 6, the guide portion 100 has a cylindrically-shaped end portion 102 and a fixed protrusions 104 similarly to the first embodiment. On the other hand, a sliding portion having a stainless material is inserted and fixed at an end of the guide portion 100, and has four contact portions 212 being protruded toward the guide rails 25 at both sides of the body 210 having a smaller width than that of the guide rails 25. Accordingly, in the second embodiment, a front end of the contact portion 212 guides a movement of the cross bar while sliding on a surface of the guide rails 25. Here, the contact portion is not necessarily four, and may be modified to any suitable number.

According to the second embodiment, the contact portion is only brought into contact with the guide rail, and thus strict dimensional control of the remaining parts not being brought into contact is not necessarily required, thereby facilitating the production. In addition, an amount of material is less consumed compared to a case when the whole width of the guide rail is filled, thereby reducing the cost thereof.

Figure 7:
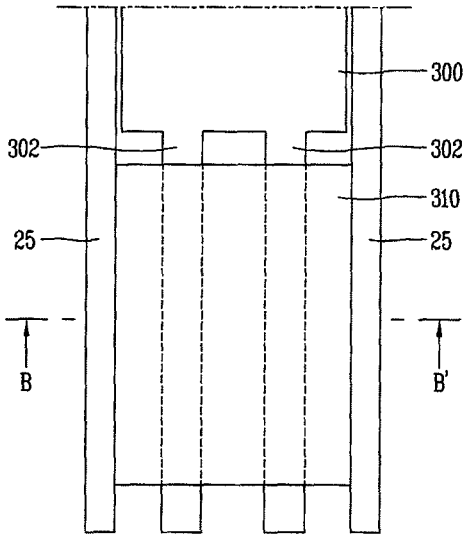
FIG. 7 is a view equivalent to FIG. 4 schematically illustrating a third embodiment of an electromagnetic contactor having an abrasion preventing means according to the present invention.
Figure 8:
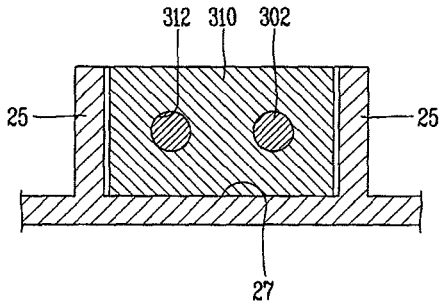
FIG. 8 is a cross-sectional view taken along the line B-B' of FIG. 7.

A third embodiment of an electromagnetic contactor according to the present invention is illustrated in FIGS. 7 and 8. The remaining configuration excluding the guide portion and sliding portion in the third embodiment is similar to the first embodiment that has been described with reference to FIGS. 1 through 3, and the redundant description thereof will be omitted.

In the third embodiment, a guide portion 300 has two cylindrically-shaped end portions 302 at the end thereof, and the end portions 302 are extended in a sliding direction of the cross bar and disposed in parallel to each other. Moreover, a holder 310 having a stainless material is fixed and provided in the guide rails 25, and the two end portions 302 are slidably inserted within a through hole 312 formed inside the holder 310.

In the third embodiment, the holder 310 maintains in a state of being fixed to the guide rail without movement, and the through hole 312 guides a sliding movement of the cross bar. In other words, the size of the holder 312 is not required to be precisely formed at a width of the guide rail, thereby facilitating the production.

Here, an example may be also considered in which the guide rail is omitted and the holder 310 is directly fixed to an inner surface of the upper frame 20. In addition, another example may be also considered in which a plate having a low friction coefficient and high rigidity such as a stainless material is adhered to an inner side of the guide rail without forming a separate sliding portion on the guide portion to prevent abrasion thereof.

What is claimed is:

1. An electromagnetic contactor, comprising:

an upper frame having a fixed contact point and a guide rail;

a cross bar comprising a sliding portion, a movable contact point contacting and separating with respect to the fixed contact point while sliding along the guide rail, and a movable core; and a lower frame comprising a fixed core disposed adjacent to the movable core, an excitation coil magnetizing the fixed core by an electromotive force, and a return spring exerting an elastic force to the cross bar, wherein the sliding portion is configured separately from the cross bar, and a material forming the sliding portion has a friction coefficient against the guide rail less than that of the cross bar, and the cross bar and the sliding portion are both engaged with the guide rail.

2. The electromagnetic contactor of claim 1, wherein the sliding portion has a block form extending from a side of the cross bar in a sliding direction.

3. The electromagnetic contactor of claim 2, wherein both ends of the contact surface of the sliding portion adjoining the guide rail are rounded.

4. The electromagnetic contactor of claim 1, wherein the sliding portion is made of a stainless material.

5. The electromagnetic contactor of claim 1, wherein the sliding portion formed of a plate, which surrounds part of the cross bar.

6. An electromagnetic contactor, comprising:

a frame having a guide rail thereinside;

a cross bar having a movable contact point, which slides along the guide rail;

a fixed contact point contacting or separating with respect to the movable contact point; and an actuator moving the cross bar to a side of the fixed contact point, wherein the cross bar additionally comprises a sliding portion, a friction coefficient between the sliding portion and the guide rail is less than a friction coefficient between the cross bar and the guide rail, and the cross bar and the sliding portion are both engaged with the guide rail.

7. The electromagnetic contactor of claim 6, wherein the actuator comprises, a movable core mounted at the cross bar;

a fixed core mounted at the frame; and an excitation coil magnetizing the fixed core by an electromotive force.

* * * * *